US005157875A

United States Patent [19]

Hill

[11] Patent Number: 5,157,875

[45] Date of Patent: Oct. 27, 1992

[54] APPARATUS FOR CUTTING AND SHAPING MATERIAL

[75] Inventor: Philip D. Hill, Muskogee, Okla.

[73] Assignee: Coburn Optical Industries, Inc., Tulsa, Okla.

[21] Appl. No.: 717,646

[22] Filed: Jun. 19, 1991

[51] Int. Cl.[5] ..... B24B 41/06

[52] U.S. Cl. ..... 51/217 L; 279/50

[58] Field of Search ..... 51/216 LP, 216 R, 216 P, 51/217 R, 217 P, 217 L, 284 R, 233; 279/50; 409/233

[56] References Cited

U.S. PATENT DOCUMENTS 4,277,916 7/1981 Buhler ..... 51/217 L 4,856,234 8/1989 Goins ..... 51/217 L

*Primary Examiner*—Bruce M. Kisliuk

*Assistant Examiner*—Eileen Morgan

*Attorney, Agent, or Firm*—Burns, Doane, Swecker & Mathis

[57] ABSTRACT

An apparatus for cutting and shaping a material is disclosed which includes securing means for securing an adaptor having a lens blank or a semi finished lens is fixed thereto to apparatus for working. The securing means comprises a generally cylindrical housing having first and second ends and a throughbore, the first end having a plurality of axial slots defining a plurality of finger-like members which can act as a collet. A piston is disposed within the throughbore and is axially movable therein, the piston being connected to a sleeve member which is mounted so that it surrounds the plurality of finger-like members. The securing means further comprises means for moving the piston relative to the housing and means for defining a sealed fluid chamber between the piston and the piston moving means. In use a non-compressible fluid fills the fluid chamber and activation of the piston moving means moves the piston within the throughbore thereby moving the sleeve members so as to close the finger-like members around the adaptor thereby securing the adaptor within the cylindrical housing.

6 Claims, 3 Drawing Sheets

APPARATUS FOR CUTTING AND SHAPING MATERIAL

This invention relates to an apparatus for cutting and shaping material. More particularly it relates to an apparatus for cutting and shaping lens material.

Many spectacle lenses are manufactured from lens blanks which have been subjected to a generating operation such as grinding. The lens blank, which may be a partially finished lens, is held in an adaptor known as a blocking adaptor. In order for a lens generating operation to be carried out on the lens blank, the blocking adaptor must be clamped in a secure manner. Clamping systems presently in use include hydraulic and pneumatic systems. In order to generate hydraulic pressures which are sufficient to securely clamp the blocking adaptor it has been necessary to provide relatively large hydraulic systems which are cumbersome and relatively difficult to maintain.

It is an object of the present invention to provide an apparatus for cutting and shaping material, in particular a lens blank or a partially finished lens, in which the clamping system for clamping the blocking adaptor is a hydraulic system which is relatively small in size and substantially portable.

According to an aspect of the invention there is provided an apparatus for cutting and shaping a material, said apparatus including means for securing an adaptor wherein a lens blank or a semi-finished lens is secured to said adaptor, said securing means comprising:

a generally cylindrical housing having a first end, a second end and a throughbore, said first end having a plurality of axial slots defining a plurality of finger-like members which can act like a collet;

a piston disposed within said throughbore and axially movable therein, said piston being connected to a sleeve member mounted to surround said plurality of finger-like members;

means for moving said piston relative to said housing;

means for defining a sealed fluid chamber between said piston and said piston moving means, whereupon in use an incompressible fluid fills said fluid chamber and activation of said piston moving means moves said piston within said throughbore thereby moving said sleeve member to close said finger-like members around said adaptor thereby securing said adaptor to said cylindrical housing.

In a preferred embodiment of the invention the piston moving means include a ratchet mechanism, preferably a rotary ratchet mechanism. Furthermore, it is also desirable to connect the piston to the sleeve member by way of a pin member extending through at least one aperture provided in the sleeve member, at least one corresponding aperture provided in the housing and a cross-bore provided in the piston.

According to a further aspect of the present invention there is provided an apparatus for cutting and shaping a material, said apparatus including means for securing an adaptor wherein a lens blank or a semi-finished lens is secured to said adaptor, said securing means comprising:

a first generally cylindrical housing having a first end, a second end and a throughbore, said first end having a plurality of axial slots defining a number of finger-like members which can act like a collet;

a piston disposed within said throughbore and axially movable therein, said piston being connected to a sleeve member mounted to surround said plurality of finger-like members;

means for closing said second end of said housing thereby defining a sealed fluid chamber between said piston and said closing means;

a second generally cylindrical housing including a cavity, a piston disposed within said cavity arranged for axial movement within said cavity thereby defining a variable volume fluid chamber;

means for moving said piston disposed within said second housing;

fluid communication means between the fluid chamber of said first housing and the fluid chamber of said second housing, whereupon in use activation of said piston moving means transfers a non-compressible fluid held within the fluid chamber of said second housing to the fluid chamber of said first housing via said fluid communication means, thereby axially moving the piston disposed within said first housing thereby moving said sleeve member to close said finger-like members around said adaptor, thereby securing said adaptor to said cylindrical housing.

In a preferred embodiment of the invention the piston moving means include a ratchet mechanism, preferably a rotary ratchet mechanism, so that a handle associated with the rotary ratchet mechanism can be positioned for convenient operation of the system by an operator. Furthermore, it is also desirable to connect the piston to the sleeve member by way of a pin member extending through at least one aperture provided in the sleeve member, at least one corresponding aperture provided in the first housing and a cross-bore provided in the piston.

It is also preferable that the means for closing the second end of the first housing include an end cap and a retainer ring for holding the end cap in a fixed position relative to the first housing. Furthermore, the fluid communication means preferably comprise a conduit.

An advantage of this embodiment of the invention is that by providing two housings in fluid communication via a conduit, it is possible to locate one housing remote to the other if desired.

A further advantage is that the hydraulic system is relatively portable and such portable hydraulic systems are not presently available.

An embodiment of the invention will now be described by way of example only with reference to the following drawings. In the drawings.

Figure 1:
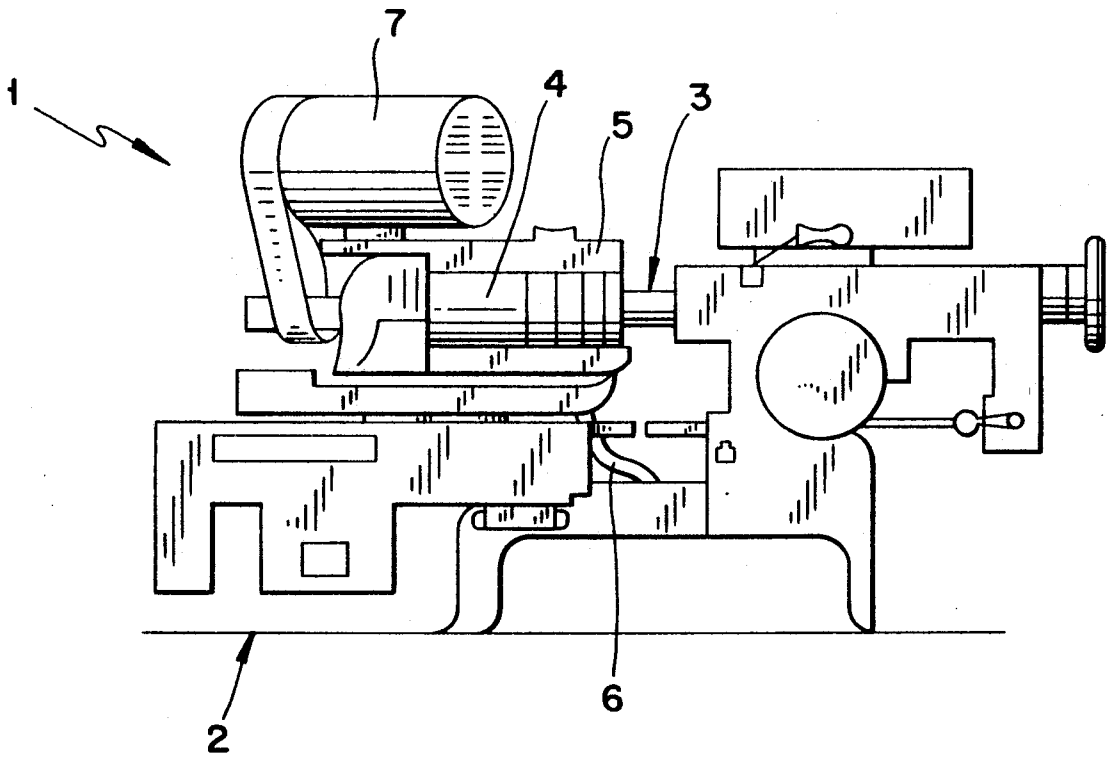
FIG. 1 is a schematic side view of a lens generator.

Referring to FIG. 1 a lens generator 1 is shown which has essentially the same components as presently known lens generators and consequently only a brief description will be given here. The lens generator includes a base, shown generally at 2, upon which is mounted a motorized grinder or cutting wheel 4. A lens clamping apparatus 3 is mounted to move linearly into and out of housing 4 and a swarf extraction hood 5 is mounted to housing 4. A drain conduit 6 is connected to the swarf extraction hood 5 to extract swarf from the hood 5. A grinder drive motor 7 is also provided which rotates the grinder or cutting wheel within housing 4.

Figure 2:
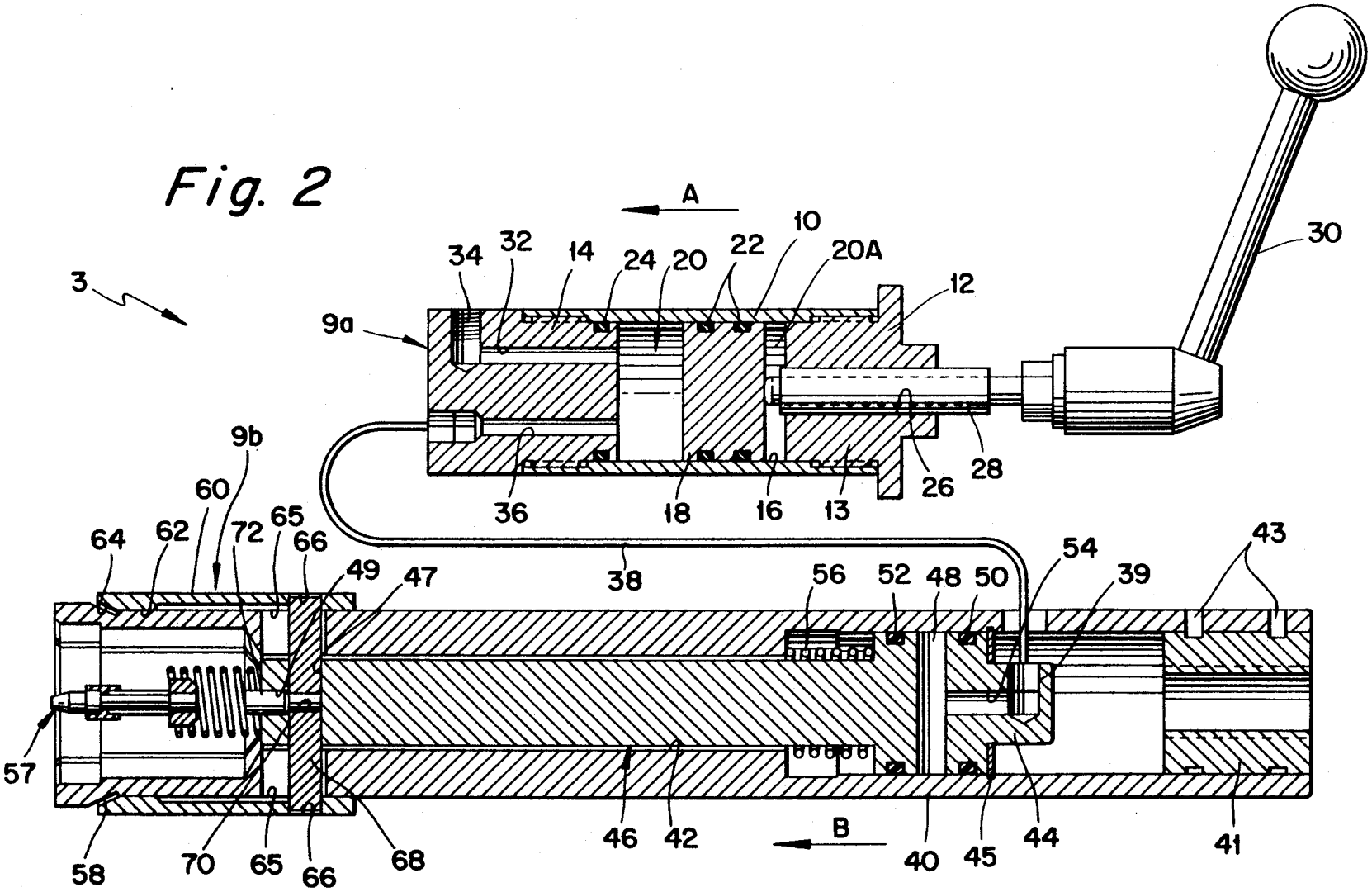
FIG. 2 is a section on a clamping means incorporated in the lens generator.

FIG. 2 shows the lens clamping apparatus 3 comprising a pressure inducing cylinder 9*a* and a clamping cylinder 9*b* joined by conduit 38. Pressure inducing cylinder 9*a* comprises a first tubular member 10 which is closed at its ends by closure elements 12 and 14, thereby defining a cavity 16. A piston 18 is disposed cavity 16 and is axially movable therealong. Piston 18 divides the cavity 16 into a fluid chamber 20 defined between piston 18 and closure element 14 and a second chamber 20A defined between piston 18 and closure element 12. The chambers 20 and 20A sealed from one another by O-rings 22 and 24.

Closure element 12 includes a nut 13 having a threaded throughbore 26 into which an elongate threaded member 28 is engaged. Threaded member 28 is secured to a rotatable handle 30. Closure element 14 includes a bore 32 which leads to a bleeder hole 34, and a bore 36 which leads to conduit 38.

Figure 3:
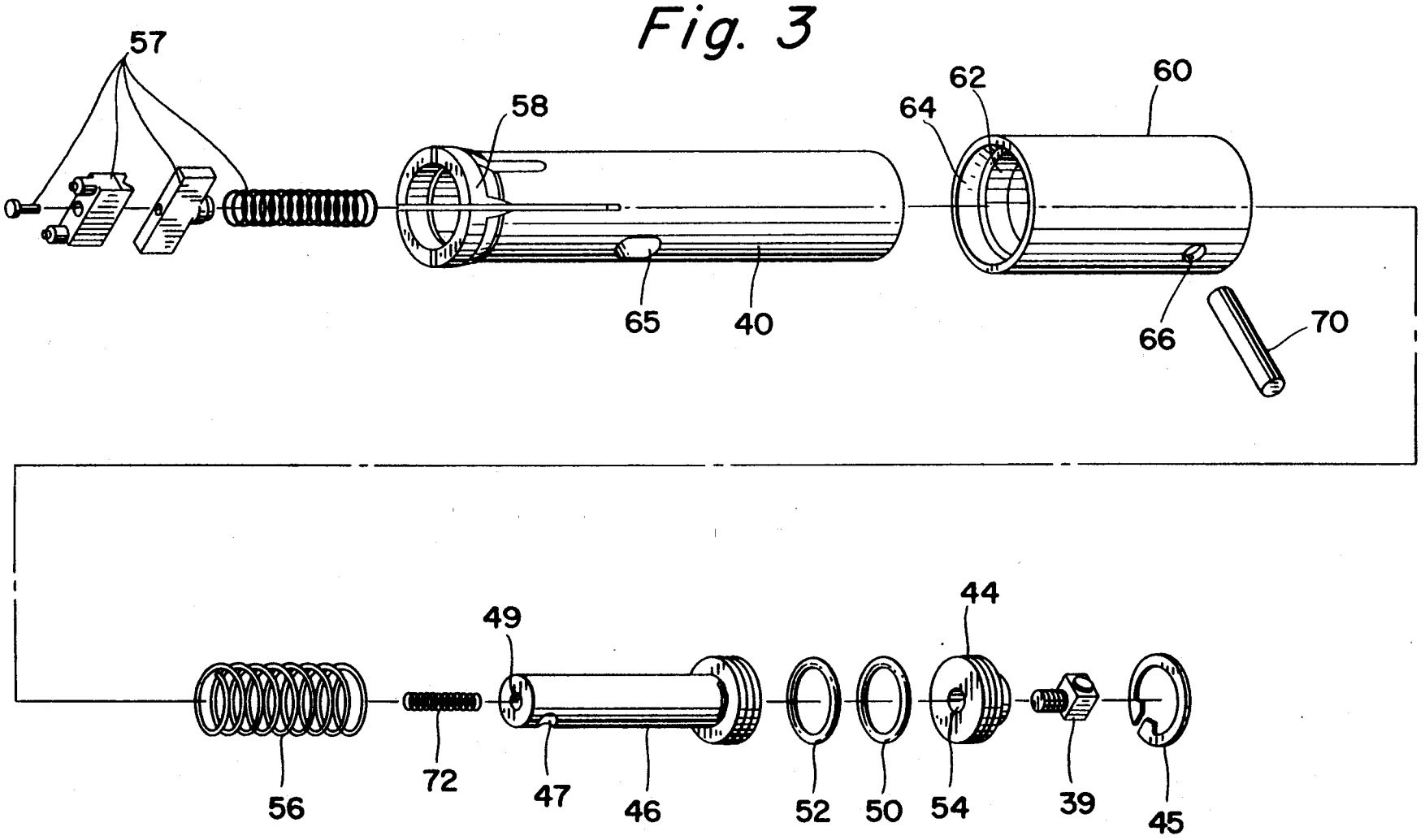
FIG. 3 is an exploded perspective view of the clamping apparatus of the clamping means of FIG. 2.

Clamping cylinder 9*b* comprise a second tubular housing 40 is also provided and FIG. 3 shows its associated apparatus. The housing 40 has a throughbore 42 which is relatively narrow at one end and relatively large towards the other end. A plug 41 having a throughbore is located at the end of the housing where the bore 42 is relatively large and is secured thereto by grub screws 43. The end of the housing where bore 42 is relatively large is closed by a closure element 44 which is held in a fixed position relative to the housing 40 by a retainer ring 45. A piston 46 extends throughout the remainder of bore 42 and is axially movable within housing 40. A fluid chamber 48 is defined between piston 46 and closure element 44, the chamber being sealed by O-rings 50 and 52. Piston 46 has a cross bore 47 towards one of its ends and an axial threaded bore 49 intersects cross bore 47.

Closure element 44 includes a bore 54 in fluid communication with conduit 38 via elbow joint 39, thus fluid chamber 48 is in fluid communication with fluid chamber 20 via bore 54, conduit 38, elbow 39 and bore 36.

A return spring 56 is provided around the piston 46 in the part of the housing 40 having a relatively large bore. The other end of housing 40 has four axial slots defining four finger-like members which can act as a collet, within which a known type of spring loaded centering device, generally illustrated as 57, is held. The collet is suitable for holding an adaptor for grinding a lens, known as a blocking adaptor, when closed. The diameter of housing 40 at the collet end is slightly larger than the diameter of the remainder of the housing, and an angled surface 58 joins the different diameter surfaces.

A rigid sleeve member 60 surrounds the collet end of the housing and has an inwardly projecting flange 62. Between flange 62 and one end of sleeve member 60, the inner surface 64 of the sleeve member is angled to cooperate with surface 58 of housing 40.

Towards the collet end of housing 40, two diametrically opposed slots 65 are provided. Sleeve member 60 has a pair of diametrically opposed apertures 66, and the sleeve member 60 is arranged to fit over the housing 40 such that apertures 66 correspond with slots 65. A pin 68, having a cross-bore 70 disposed halfway along its length, is inserted through the apertures 66 of sleeve member 60, the slots 65 of housing 40 and the cross bore 47 of piston 46 to fasten the piston 46 to sleeve member 60. A set screw 72 is engaged into the threaded bore 49 of the piston and threaded bore 70 of the pin to secure the pin within the piston.

To operate the apparatus a non-compressible fluid, for example oil, is introduced into fluid cavity 20 via bleeder hole 34 and bore 36. The system is then bled in a conventional manner and the apparatus is ready for operation.

A blocking adaptor (not shown) is inserted into the collet end of the housing 40 and handle 30 is rotated. This rotation forces threaded member 28 to rotate in the threaded bore 26 and push piston 18 in the direction of arrow A in FIG. 2. Movement of the piston forces non-compressible fluid to be transferred to chamber 48 from chamber 20 via bore 36, conduit 38, elbows 39 and bore 54. As closure element 44 is fixed in position relative to housing 40 by retainer ring 45, the fluid entering cavity 48 effects axial movement of the piston 46 in the direction of arrow B in FIG. 2. As the piston 46 is fastened to the sleeve member 60, movement of the piston causes the sleeve member to slide over the collet end of the housing 40. Angled surfaces 58 and 64 facilitate complete enclosure of the sleeve member over the collet section whereupon the collet closes to firmly clamp the blocking adaptor. Lens grinding operations may now be carried out on a lens secured to the blocking adaptor.

When the lens grinding operations have been completed, the handle 30 is rotated in such a way as to relieve the hydrostatic pressure of the system. Return spring 56 acts to force the fluid from chamber 48 to chamber 20 via bore 54, conduit 38, elbow 39 and bore 36.

It will be appreciated that although the diameter of the fluid chambers 20 and 48 have been shown to be substantially the same, they may be altered to amplify or de-amplify the hydraulic effect as desired.

It will also be appreciated that fluid chambers 20 and 48 may be connected directly by a hydraulic conduit, effectively providing one fluid chamber. Fluid transfer through the hydraulic conduit will move the piston held in the clamping cylinder in the aforedescribed manner thereby closing the finger-like projections to firmly clamp the blocking adaptor.

I claim:

1. In an apparatus for cutting and shaping a lens element including means for securing an adaptor wherein a lens element is secured to said adaptor, said securing means comprising:

a first generally cylindrical housing having a first end, a second end and a throughbore, said first end having a plurality of axial slots defining a number of finger-like members which constitute a collet;

a first piston axially movable within said throughbore and connected to a sleeve member mounted to surround said plurality of finger-like members and press said finger-like members radially inwardly when said first piston is at one end of its stroke;

means for closing said second end of said first housing so that a first sealed fluid chamber is formed at one side of said piston;

a second generally cylindrical housing including a cavity, a second piston axially movable within said cavity, said cavity defining a second sealed fluid chamber disposed at one side of said second piston;

said first and second fluid chambers being fluidly interconnected and containing an incompressible fluid; and a manually actuable handle operably connected to said second piston for axially moving said second piston within said second chamber to pressurize said fluid in said first and second chambers, thereby axially moving said first piston and said sleeve to press said finger-like members radially inwardly against said adaptor to secure the adaptor to said first housing.

2. An apparatus as claimed in claim 1, wherein said first and second fluid chambers are of substantially the same diameter.

3. An apparatus according to claim 1, wherein said manually actuable handle comprises a rotatable handle connected to said second housing by a screw connection.

4. An apparatus according to claim 1 including a threaded member having an external screw thread connected to an internal screw thread of said second housing, said manually actuable handle comprising a rotatable handle connected to an outer end of said threaded member, an inner end of said threaded member configured to abut against and push said second piston in response to rotation of said handle in a first direction, spring means for biasing said first piston in a direction for releasing the adaptor when said handle is rotated in a second direction.

5. An apparatus as claimed in claim 1 wherein said means for closing said second end of said first housing include an end cap and a retainer ring for holding said end cap in a fixed position relative to said first housing.

6. An apparatus as claimed in claim 1 wherein said piston is connected to said sleeve member by way of pin member extending through at least one aperture provided in said sleeve member, at least one corresponding aperture provided in said first housing, and a cross bore provided in said piston.

* * * * *